United States Patent [19]

Hirsch

[11] Patent Number: 4,513,896

[45] Date of Patent: Apr. 30, 1985

[54] BELT OR STRAP

[75] Inventor: Hermann Hirsch, Klagenfurt, Austria

[73] Assignee: Hermann Hirsch Leder- und Kunststoffwarenfabrik, Klagenfurt, Austria

[21] Appl. No.: 499,514

[22] Filed: May 31, 1983

[30] Foreign Application Priority Data

Jun. 17, 1982 [AT] Austria ..... 2346/82

[51] Int. Cl.[3] ..... A44C 5/00

[52] U.S. Cl. ..... 224/178; 24/265 WS

[58] Field of Search ..... 224/164, 165, 178; 24/3 A, 265 WS, 265 R, 265 B, 265 EE; 2/311; 156/185, 186, 187, 242; 428/158-160; 63/3-7; 368/282

[56] References Cited

U.S. PATENT DOCUMENTS

| | | | |
|---|---|---|---|
| 2,658,015 | 11/1953 | Williams | 156/242 X |
| 2,927,876 | 3/1960 | Hoppe et al. | 428/160 |
| 2,937,968 | 5/1960 | Sauer | 156/242 |
| 3,322,610 | 5/1967 | Brooks et al. | 428/159 X |
| 3,362,595 | 1/1968 | Herzog | 224/178 |
| 3,475,264 | 10/1969 | Donaldson | 24/265 R X |
| 3,977,054 | 8/1976 | Moore et al. | 24/265 R |
| 4,183,986 | 1/1980 | Blatterlein | 224/178 X |

FOREIGN PATENT DOCUMENTS

| | | | |
|---|---|---|---|
| 364557 | 10/1981 | Fed. Rep. of Germany . | |
| 1097999 | 7/1955 | France | 24/265 WS |
| 432568 | 7/1935 | United Kingdom | 224/178 |

*Primary Examiner*—Stephen Marcus
*Assistant Examiner*—Robert Petrik
*Attorney, Agent, or Firm*—Young & Thompson

[57] ABSTRACT

A belt or strap consists of face material 1 and lining 2, both of which consist particularly of leather and are interconnected by an elastic layer 3. The longitudinal edges 4, 6 of the face material and/or lining are laterally bent and extend over part of the longitudinal edge 5 of the belt or strap. The material of the elastic layer 3 extends from the underside (in case of leather from the flesh side) into the face material and lining and extends as far as to the outermost portions 7 of the longitudinal edges 5 of the belt or strap.

5 Claims, 10 Drawing Figures

FIG.1
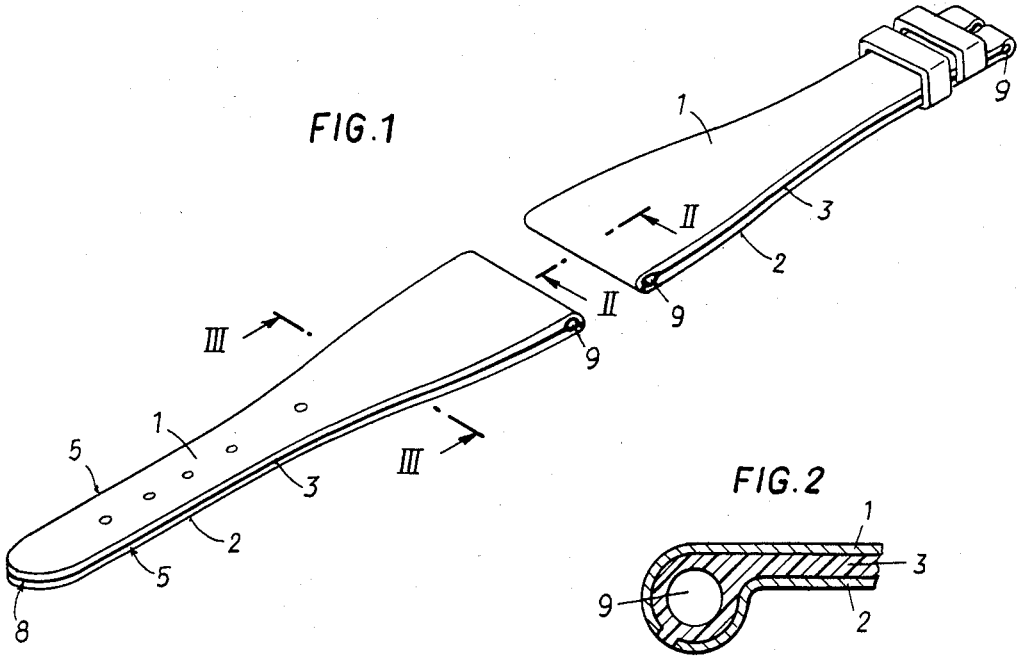
FIG.2
FIG.3
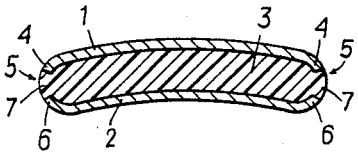
FIG.4
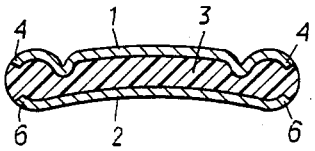
FIG.5
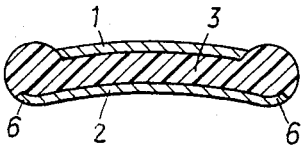
FIG.6
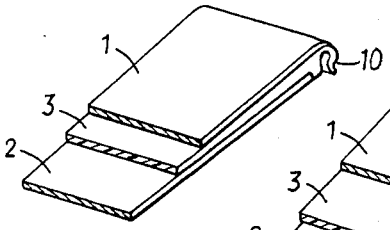
FIG.7
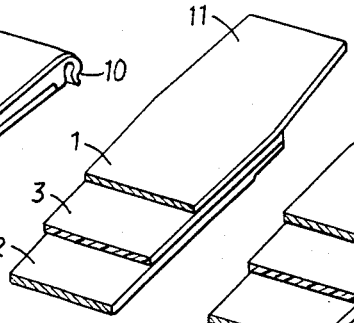
FIG.7a
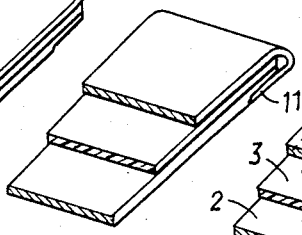
FIG.8
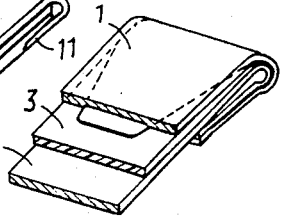
FIG.9
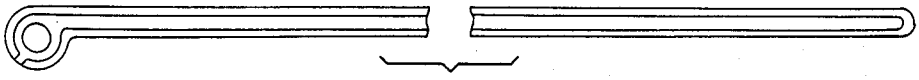

BELT OR STRAP

This invention relates to a belt or strap consisting of a face material and a lining, particularly face leather and lining leather, which are interconnected by an elastic layer.

A two-layer belt or strap in which the two layers are interconnected by a carrier which is substantially I-shaped in cross-section is known from Austrian Patent Specification No. 364,557.

A problem arising in connection with belts or straps is the reliable protection of their longitudinal edges, which are subjected to particularly high stresses especially adjacent to the buckles and in belts used as watch straps adjacent to the loops by which the belt or strap is secured to a watch. Besides, the face leather and lining leather should be interconnected adjacent to the longitudinal edges of the belt or strap by joints which are as moisturetight as possible so that an absorption of moisture by the material of the belt or strap will be prevented. Such absorption takes places preferentially through the flesh side of leather.

It is an object of the invention to provide a belt or strap which is of the kind mentioned first hereinbefore and which can be made in a simple manner and is reliably protected at its longitudinal edges.

In accordance with the invention, the face material and/or the lining is bent downwardly or upwardly, respectively, at the longitudinal edges of the belt or strap, the bonding layer extends adjacent to the longitudinal edges as far as to the outside surface of the face material and the lining, and the bonding layer extends from the underside, e.g., from the flesh side of leather, into the face material and the lining.

Due to the feature according to the invention, the outermost portions of the longitudinal edges are constituted by the side edges of the bonding layer so that the belt or strap is effectively protected in the region of its longitudinal edges. Because the bonding layer extends from the flesh side into the face leather and the lining leather, the longitudinal edges of the face leather and lining leather are reliably fixed and are sealed against an ingress of moisture.

Further details and features of the invention will become apparent from the appended claims and from the following description of the preferred embodiments shown by way of example on the drawing, in which FIG. 1 shows a strap which constitutes a watch strap, FIG. 2 is a sectional view taken on line II—II in FIG. 1, FIG. 3 is a sectional view taken on line III—III in FIG. 1 and FIGS. 4 and 5 show different cross-sectional shapes, FIGS. 6 to 8 show different ways in which a loop can be formed in the belt or strap according to the invention and FIG. 9 shows an edge view of a modified form of belt or strap.

The belt or strap shown in FIG. 1 is a two-part watch strap. Each part of the strap consists of a face leather 1 and a lining leather 2, which are interconnected by an elastic bonding layer 3, thereby simulating an all-leather flexible strap. As is apparent from the drawing, the elastic bonding layer 3 is substantially thicker than face leather 1 or lining leather 2, the leather layers thus constituting relatively thin veneers.

As is apparent from FIG. 3, the longitudinal edges 4 of the face leather 1 are bent downwardly and the longitudinal edges 6 of the lining leather 2 are bent upwardly adjacent to the longitudinal edges 5 of the belt or strap. The longitudinal edges 4 and 6 do not contact each other but their terminations are spaced apart. The bonding layer 3 fills the space between the longitudinal edges 4 and 6. As a result, the outermost portions 7 of the longitudinal edges 5 of the belt or strap according to the invention are constituted by the bonding layer 3.

The material of the bonding layer 3 penetrates from the flesh side into the face leather 1 and into the lining leather 2 so that the face leather 1 and the lining leather 2 are impregnated from their inside (flesh side) particularly adjacent to the longitudinal edges 5.

In the embodiment shown in FIG. 3 and in the embodiment shown in FIG. 4, in which the belt or strap is transversely profiled because it is provided with longitudinal grooves in the face leather 1, each of the edges 4 and 6 extends over one-third of the overall width of the corresponding longitudinal edge 5.

As is shown in FIG. 4, the belt or strap can be profiled without a need for a special treatment of the face leather 1 or without a need to use a face leather 1 which has different thicknesses.

The design which has been described for the longitudinal edges 5 can be similarly adopted adjacent to the pointed or rounded end 8 of the belt or strap and adjacent to the loops 9. As is particularly apparent from FIG. 2 the face leather 1 and the lining leather 2 extend around only part of the loop 9 and the space between them is filled with plastic material 3.

FIG. 5 is a transverse sectional view showing a belt or strap in which the face leather does not extend into the longitudinal side edges 5 but terminates before them. On the other hand, the lining leather 2 has edges 6 which have been bent upwardly into the region of the longitudinal edges 5.

The loop or eyelet 9 may be provided as is shown in FIG. 1. Alternatively, the belt or strap according to the invention may be provided with different loops or with hooks for fixing the belt or strap. Various possible designs are shown in FIGS. 6 to 8.

FIG. 6 shows a hook-in strap, in which a hook 10 is covered by the face leather 1 and consists of the layer 3, by which the face leather 1 and the lining leather 2 are interconnected. The hook 10 may be provided with detent means for closing the hook.

FIGS. 7 and 7*a* show an adhesively fixed loop. As is shown in FIG. 7*a*, that portion 11 of the face leather 1 which protrudes beyond the end of the belt or strap can be adhesively fixed to the underside of the belt or strap so that a loop is formed.

FIG. 8 shows another loop, which is resilient because it has been provided with an inserted leaf spring so that the loop need no longer be fixed by an adhesive joint. The leaf spring may be substantially U-shaped and may be incorporated in the belt or strap according to the invention during the manufacture of such belt or strap.

In another emnbodiment, the face leather 1 and the lining leather 2 may consist of a single blank, which has been reversely bent in the region in which the loop is to be formed. In that case the loop is similar to that shown in FIG. 2 but the face leather 1 merges continuously into the lining leather 2.

An advantage afforded by the belt or strap according to the invention resides in that belts or straps which are, e.g., wedge-shaped, i.e., which taper in thickness from one end to the other, as shown in FIG. 9, can be made in a simple manner from leather blanks of uniform thickness for the face leather and the lining leather if the bonding layer has a suitable wedge shape. By means of suitable molds, any desired surface structures can be provided even when face leather blanks of uniform thickness are used. The difficult and time-containing dressing (thinning and scarfing) of leather is no longer required.

In another embodiment, not shown, the longitudinal edges of the face leather 1 and/or lining leather 2 may be scarfed. The resulting longitudinal edges 4 and 6 of the face leather 1 and lining leather 2 are very thin and in the finished belt or strap have a very small spacing, which may amount to one or a few tenths of a millimeter. In that embodiment the bonding layer 3 is almost invisible at the longitudinal edges 5.

The invention is not restricted to belts or straps made of leather. The face material and/or the lining may be made of a different material, into which the material of the bonding layer can penetrate from the underside.

I claim:

1. A flexible strap that simulates an all-leather strap, comprising a face material of leather and a lining of leather interconnected by an elastic layer whose thickness is substantially greater than that of the face material or the lining, at least one of said face material and lining being bent partway about said elastic layer at the longitudinal edges of the strap, the elastic layer extending adjacent to the longitudinal edges of the face material and lining as far as to the outside surface of the face material and the lining, the leather of said face material and lining having the flesh side adjacent and impregnated by said elastic layer.

2. A strap as claimed in claim 1, in which said elastic layer extends edgewise outwardly beyond said face material and said lining.

3. A strap as claimed in claim 1, in which the edges of said at least one of said face material and lining are smoothly curved to be outwardly convex.

4. A strap as claimed in claim 1, in which said face material and lining are of substantially uniform thickness and said elastic layer varies in thickness.

5. A strap as claimed in claim 4, in which said variation in thickness is lengthwise of said strap.

* * * * *